US005225741A

United States Patent [19]

Auld, Jr. et al.

[11] Patent Number: 5,225,741

[45] Date of Patent: Jul. 6, 1993

[54] ELECTRONIC BALLAST AND POWER CONTROLLER

[75] Inventors: Samuel H. Auld, Jr., Reno, Nev.; Mangalam K. Balachander, Kent, Wash.; Douglas W. Brooks, Carson City; Steven M. Jenkins, Dayton, both of Nev.; Jacek J. Marcinkowski, San Pedro, Calif.

[73] Assignee: Bruce Industries, Inc., Dayton, Nev.

[21] Appl. No.: 488,991

[22] Filed: Mar. 6, 1990

Related U.S. Application Data

[63] Continuation-in-part of Ser. No. 322,129, Mar. 10, 1989, abandoned.

[51] Int. Cl.[5] ..... H05B 41/36

[52] U.S. Cl. ..... 315/307; 315/223; 315/226; 315/DIG. 7

[58] Field of Search ..... 315/307, 247, 226, 223, 315/DIG. 7, DIG. 5

[56] References Cited

U.S. PATENT DOCUMENTS

| | | | |
|---|---|---|---|
| 2,418,161 | 4/1947 | Campbell | 315/247 X |
| 4,394,603 | 7/1983 | Widmayer | 315/307 X |
| 4,415,839 | 11/1983 | Lesea | 315/247 X |
| 4,464,606 | 8/1984 | Kane | 315/307 X |
| 4,503,363 | 3/1985 | Nilssen | 315/307 X |
| 4,506,195 | 3/1985 | Elms | 315/247 X |
| 4,544,863 | 10/1985 | Hashimoto | 315/223 X |
| 4,614,897 | 9/1986 | Kumbatovic | 315/307 X |
| 4,641,061 | 2/1987 | Munson | 315/226 X |
| 4,700,113 | 10/1987 | Stupp et al. | 315/DIG. 7 X |
| 4,777,409 | 10/1988 | Tracy et al. | 315/DIG. 5 X |
| 4,808,887 | 2/1989 | Fähnrich et al. | 315/247 |
| 4,914,356 | 4/1990 | Cockram | 315/307 |

*Primary Examiner*—Eugene R. LaRoche
*Assistant Examiner*—Do Hyun Yoo
*Attorney, Agent, or Firm*—Beehler & Pavitt

[57] ABSTRACT

A relatively high efficiency, relatively light weight, relatively small electronic ballast or AC power controller for use in aircraft and elsewhere for controlling a fluorescent lamp load or other load includes an EMI filter, a multi-purpose transformer, a power conversion stage and a control circuitry stage. The ballast or controller operates to increase or decrease the voltage of the incoming sine wave AC voltage through a charging path for an energy storage inductor choke cooperating with an energy storage capacitor wherein the charging path for the capacitor is different from the discharge path of the capacitor to isolate the load from the charging of the capacitor and thus to provide an output to the load which is independent of the charging path and which is out of phase with the incoming waveform. This is achieved through conversion of the incoming AC power to a higher frequency and to a higher or lower voltage, under the control of a switching system and reconversion to the input frequency, followed by filtering to remove the high frequency components. The system includes various novel feedback loops for the lamp current and the like for control of lamp current and dimming control. Various forms are described including a high efficiency form in which the incoming power is added to the ballast output for operation of the lamp load.

37 Claims, 8 Drawing Sheets

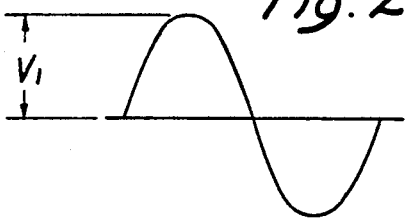
Fig. 2a
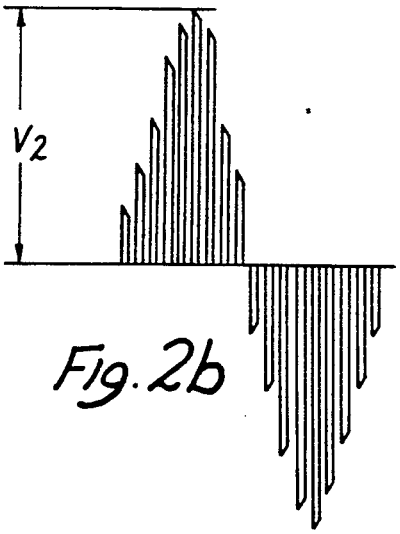
Fig. 2b
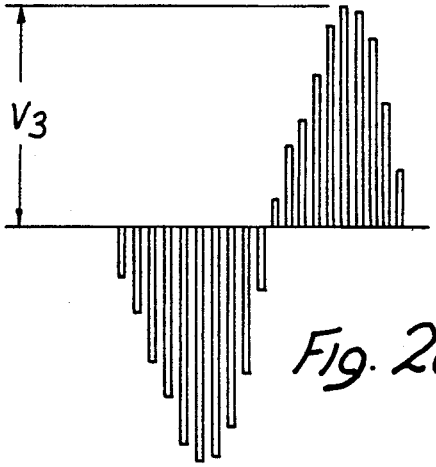
Fig. 2c
Fig. 2d
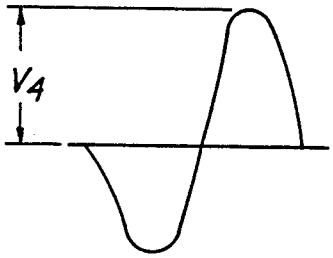
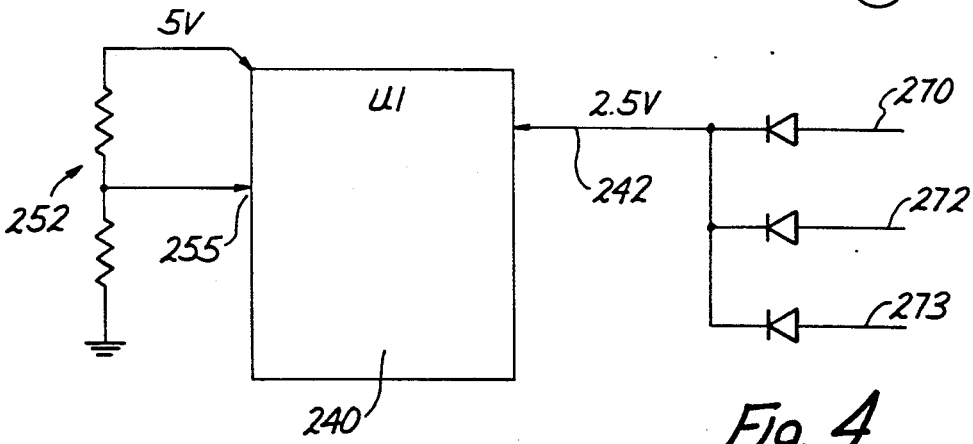
Fig. 4
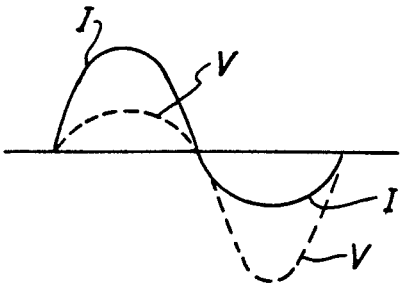
Fig. 4A

ELECTRONIC BALLAST AND POWER CONTROLLER

RELATED APPLICATIONS

This is a continuation-in-part of application Ser. No. 07/322,129 filed on Mar. 10, 1989 and assigned to the same assignee abandoned.

FIELD OF THE INVENTION

This invention relates to ballasts for fluorescent lamps and more particularly to an improved, light weight, electronic ballast of increased efficiency, especially for aircraft use and which may be step dimmable or variable dimmable, and to an improved AC power controller for use where it is desired to control AC power with high efficiency, light weight and high reliability.

BACKGROUND OF THE INVENTION

Ballast structures are well known for use with fluorescent lamps to provide power therefor by controlling the lamp current. Typically, these ballasts have been magnetic ballasts and are relatively large and relatively heavy, for example, between one and two and one half pounds, depending on whether they are step dimmable or continuously dimmable. Weight and size normally are not major considerations for home, industrial or commercial uses. Efficiency of the latter ballast structures likewise is not a major concern, nor is long life and replacement of ballast structures. Magnetic ballasts have an efficiency in the range of about 60%.

It is also known in the prior art to use a unit known as a Cuk converter in power supplies and which operates on a DC power input and provides a controlled DC output. That and similar type units do not convert the incoming power to 400Hz.

In the case of aircraft, however, somewhat different criteria apply. In such uses, long life, weight, size, efficiency, easy replacement and the general requirements for aircraft use present conditions which are far more demanding than the conditions that apply in home, industrial or commercial use. For example, for each pound in reduction in aircraft weight, there is a cost savings of between $400.00 to $500 00 per pound, not to mention the reduction in operating costs. Moreover, lamp life is important, more so than in other uses. Further, the need to protect the ballast from faults such as short circuits, shorted or open filaments, open circuits or rectifying lamp loads present unique considerations with respect to ballasts for use in aircraft especially those intended to operate at relatively high efficiency.

In some cases, the ballast structures are designed for the life of the aircraft, typically 60,000 hours flight time, and operate from a 115 V AC 400Hz power source. Thus, the reliability demanded for aircraft ballast systems is far greater than for conventional home, industrial or commercial Attorney Docket ballasts. The number of ballast systems may vary with aircraft type and configuration. For example, in the case of a Boeing 737, the number of ballasts may vary between 20 and 21 units, depending upon configuration of the aircraft. In the case of a Boeing 757, the number of ballast systems is nominally about 28 units. Thus, the weight due to conventional magnetic ballasts alone may be between 20 pounds to 52.5 pounds for the 737 and between 28 to 70 pounds in the case of the 757 type aircraft. A ballast weight of about 0.71 pounds represents a weight savings of 5.8 and 38.3 pounds in the case of a 737 type aircraft and between 13.8 and 55.8 pounds for the 757 type aircraft. The cost savings is between $2,300.00 and $22,320.00 per aircraft solely on the basis of weight reduction of the ballast. Further weight savings are recognized if the efficiency of the ballast is increased thus allowing a reduction in the size of the power generating equipment. An efficiency of between 85% and 91% as compared to 60% is a significant efficiency increase.

Another problem which arises in aircraft and other uses is that the input power sometimes contains frequencies other than the fundamental input frequency. For example, in the case of aircraft and other generating sources where the desired input frequency is desired to be 400 Hz, it is not uncommon to find odd and even harmonics such as 800Hz, 1200 Hz, 1600 Hz, 2000 Hz, up to about 3600 Hz and the like, with variations such as 820 Hz, 1220 Hz and so forth. When such frequencies are present at the 400 Hz input, even in amounts as small as 3% to 4%, the result is that beat frequencies occur and, depending upon the frequency, these beat frequencies may fall within a band of frequencies to which the human eye is especially sensitive, causing what is known as "flicker" in fluorescent lamps, a particularly objectionable condition because it is quite visually perceptible. In other cases, these beat frequencies cause variations from the desired frequency in those instances in which precise control of the output frequency is required. Moreover, in the case of aircraft, the radiated EMI from the power control system is a factor and the same should be reduced.

It is also known that the lamp current needed for maximum normal brightness varies with lamp type and may be in the range of 100 milliamps (mA) to 300 mA or more, depending on lamp type. It is also a fact that in the course of normal use, the lamps wear, sometimes in an uneven manner in that one of the hot cathodes may begin to decay before the other, either due to use or some anomaly in the manufacture of that particular lamp. When this takes place, some ballast systems tend to increase the current in order to maintain brightness with the result that power flowing through the ballast is increased, sometimes approaching or exceeding the design characteristics of the ballast. When this takes place, ballast life is markedly reduced. In other cases, the current to the lamp is somewhat greater than need, overdriving so-called, again with a reduction in lamp life, loss of efficiency and reduction in ballast life and reliability.

It is also known in the prior art that there is a broad range of applications in which a need for control of the magnitude of AC power is required. These applications include such items as incandescent lamp dimmers, motor controllers, AC power supplies and any application requiring the control of AC power, especially in combination with the need for high efficiency, light weight and high reliability, only to mention a few.

In accordance with this invention, many of the prior art shortcomings previously discussed are overcome.

BRIEF DESCRIPTION OF THE INVENTION

The present invention provides an improved, relatively high efficiency, relatively light weight, relatively small size electronic ballast especially adapted for aircraft use and also provides an improved AC power controller for a variety of uses.

In accordance with this invention, an electronic, step-dimmable or completely variable dimmable ballast is provided which will start and continuously operate one or more lamps of different ratings. The weight of the unit, as a ballast or power controller, is about 0.71 pounds. The correct value of lamp current is maintained in the full illumination or dimmed mode irrespective of variations of input voltage or lamp characteristics. Thus, if there is a lamp problem or a circuit problem, this is immediately apparent from a decrease in lamp intensity. The ballast operation is such that the lamp or lamps start up in unusually smooth fashion, free of life-shortening effects of instant starts. The lamp filaments are allowed to warm before the lamp strikes or starts, and the peak voltage allowed to appear across the lamp or lamps is controlled by a feedback circuit to be described. This not only adds to lamp life but also improves the long term reliability of the ballast by limiting peak voltages across all of the components, preferably semiconductors, of a power conversion section. The same operational features are present when the lamp(s) are started in the dim mode, for example, 25% of the maximum brightness. The filaments are allowed to warm and the feedback circuit is operative so there is no need to apply a repetitive high voltage pulse each half-cycle to cause the lamps to strike.

Ballast efficiency has been markedly improved and in accordance with this invention, ballast efficiency is improved as lamp load is increased beyond a specific power rating. This is achieved by using unprocessed input power to provide a portion of the power required for lamp operation. Unprocessed input power is summed with the output of a power conversion section so that the lamps receive fully controlled power, yet the input line supplies an appreciable portion of the power required thereby relieving the power conversion section from having to process all of the power. As a practical matter, lamp combinations of 45 watts (W) or less are best operated directly from the output of the ballast. Lamp combinations in excess of 45 W are best operated in the high efficiency mode, to be described. Ballast efficiency in the high efficiency mode with a lamp load of 49 W consisting of one 32 W and one 17 W lamp, for example, is 91.5% compared with 85% in the normal mode when the ballast in accordance with this invention fully powers the load.

The input power may, for example, be 115 V 400 Hz AC although the present invention is not limited thereto, but does require an AC source of generally sinusoidal waveform shape In general, the ballast of this invention includes several functional components, as follows:

(1) A multi-purpose transformer,
(2) An EMI filter,
(3) A power conversion stage, and
(4) A control circuitry.

The multi-purpose transformer is a miniature 115 V, 400 Hz transformer which accepts incoming AC power and provides suitable voltage and current levels for operation of lamp filaments, power supply voltages for the control circuitry and switching voltages for the bipolar transistors in the power conversion stage. The multi-purpose transformer does not process lamp power.

The EMI filter generally includes a differential mode inductor, a common mode inductor and capacitors. This circuit filters high frequency switching noise from the power conversion stage and prevents the return of such noise to the 115 V AC input. The EMI filter also performs a role in reducing the susceptibility of the ballast to spikes and abnormalities in the 115 V AC supply.

The power conversion stage accepts incoming sinusoidal 400 Hz power, converts it to 50 KHz, pulse width modulates at that frequency in order to control the power and then reconverts to sinusoidal 400 Hz power of the correct voltage to operate the fluorescent lamp load properly. In effect, an incoming 115 V AC waveform is increased to several hundred volts AC such that the lamp load receives clean sinusoidal AC power of exactly the same frequency as the input, but 180 degrees out of phase therewith, the output of the circuit being used in starting and running fluorescent lamps. Typically, such lamps or combinations of lamps may require up to 500 or more volts for starting purposes and must then diminish to a running voltage consistent with the current requirements of the lamps being operated.

The control circuit includes a feedback system and operates the sense the lamp current, output voltage, rectifying lamp conditions and the dimming command. These voltages are summed and used to control the pulse width of the 50 KHz driver. The result is to protect the ballast and to assure that the lamp current is maintained at a predetermined and preset level in accordance with the lamp operating requirements.

In another form, the fluorescent lamp load may be powered in part by the improved dimming ballast and in part by incoming AC power, thereby improving efficiency and reducing the work load on the components of the ballast.

Another marked improvement in the case where the input power includes frequencies other than the desired frequency, for example 400 Hz, a bandpass L-C filter, tuned to the input frequency is used and preferably connected in series with the load to remove or substantially remove frequencies other than the desired frequency. Where the load is a fluorescent lamp load, the result is to reduce or eliminate those frequencies which tend to produce a visually detectable and objectionable flicker. In other load devices, the removal or substantial reduction of frequencies other than that desired results in power output characteristics which are of a controlled and known frequency. In cases where radiated EMI is a problem, a shunt capacitor coacting with the L-C filter may be used for radiated EMI suppression, all of which will be described in detail.

From the following detailed description, it will become apparent that the ballast of the present invention offers many advantages over ballast systems of the prior art. It will also be apparent from the following specification which, together with the accompanying drawings, describes and illustrates several preferred embodiments of the present invention.

DETAILED DESCRIPTION OF THE DRAWINGS

FIG. 2A is a diagram of the input waveform;

FIG. 2B is a diagram of one of the waveforms of FIG. 2;

FIG. 2C is a diagram of another waveform of FIG. 2;

FIG. 2D is a diagram of the output waveform of FIG. 2;

FIG. 4 is a simplified diagram of the rectifying lamp feedback system;

FIG. 4A is a diagrammatic illustration of the current and voltage waveforms in a rectifying lamp condition;

Figures 3, 6:
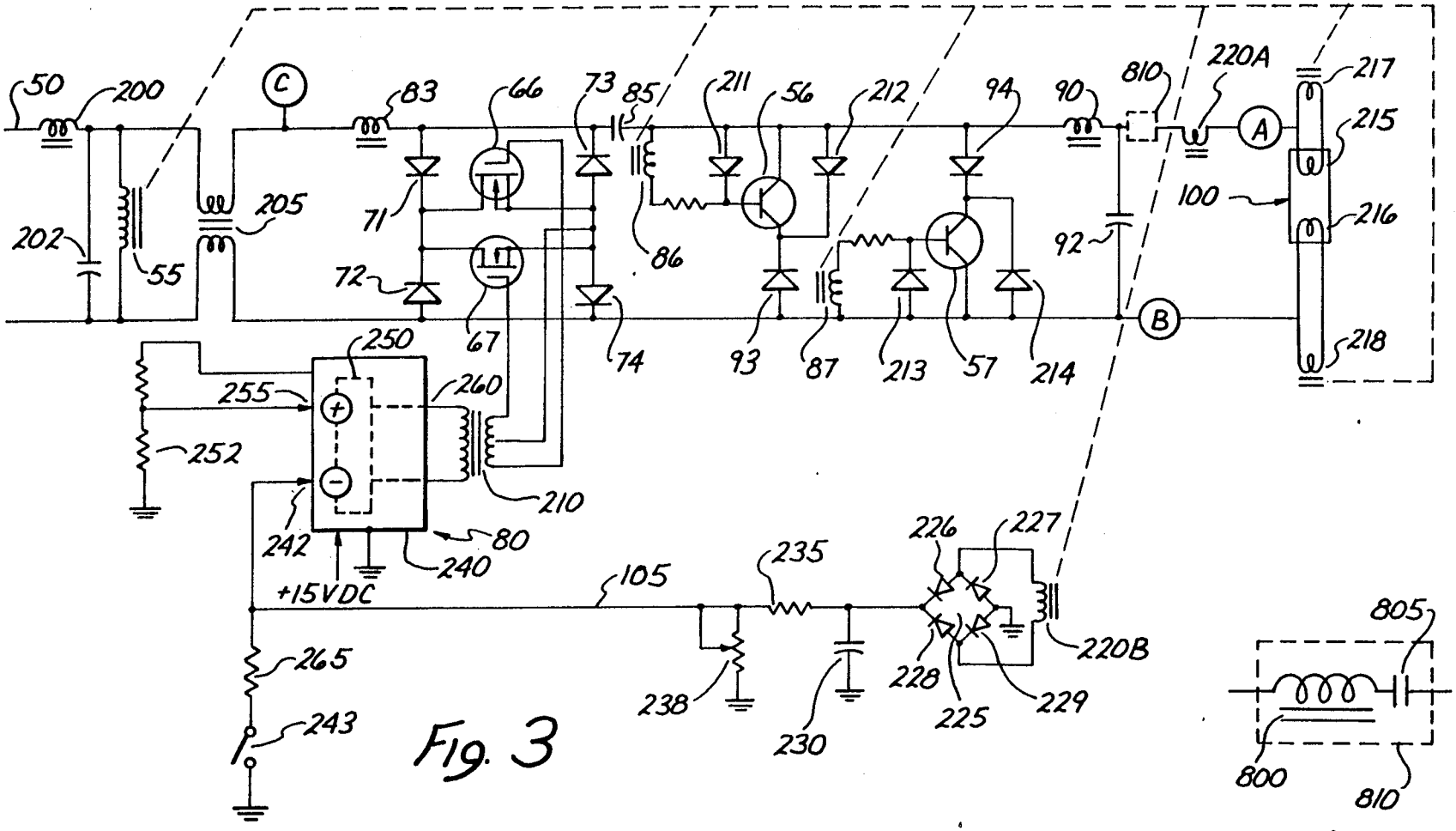
FIG. 3 is a simplified diagram of the power conversion stage and control circuit portions of the ballast system of this invention.
Figure 6A:
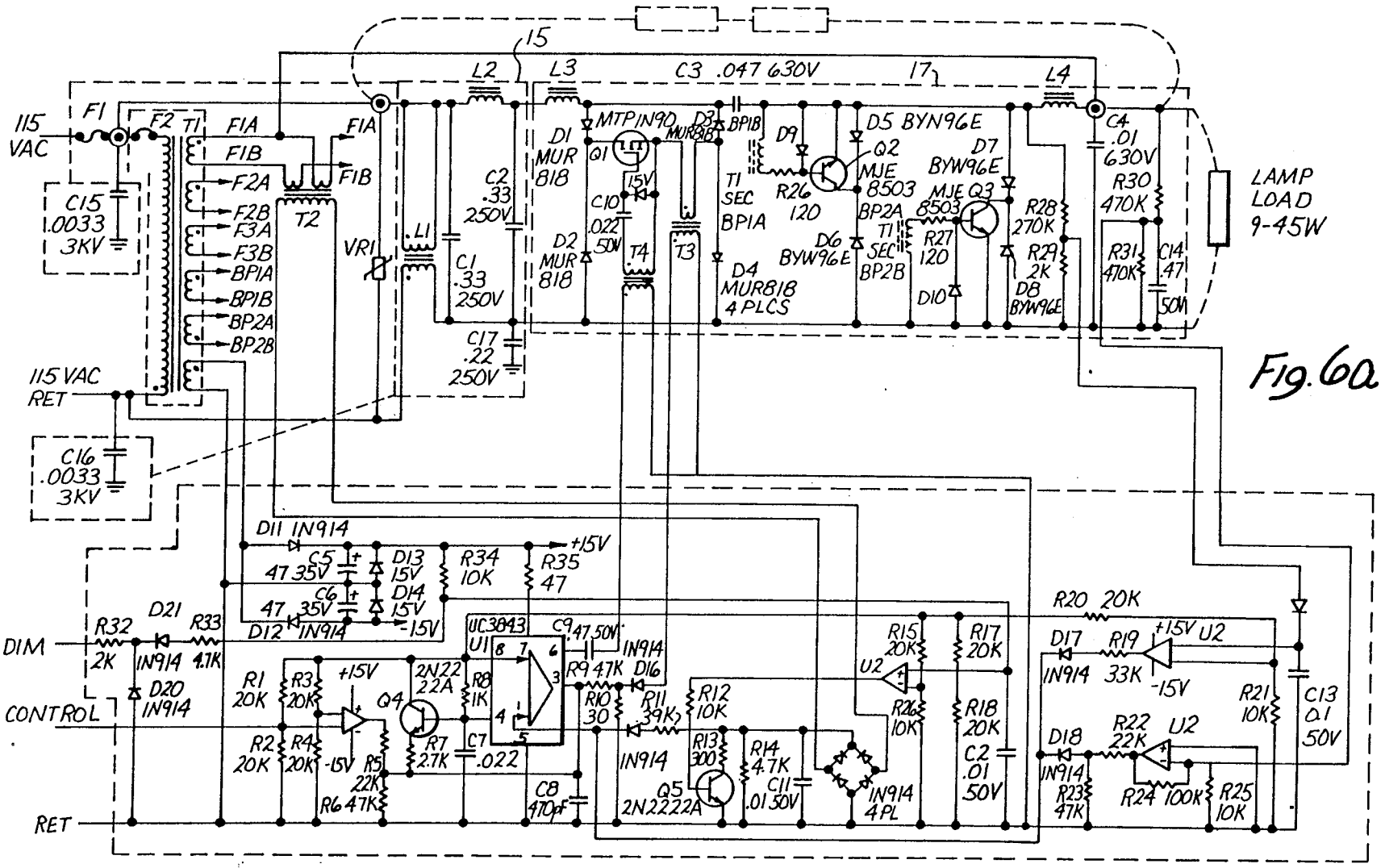

FIG. 6 in the form of two diagrams, FIGS. 6A and 6B is a detailed wiring diagram of another form of the present invention for use on aircraft, FIGS. 7A–7G are a series of drawings illustrating the high efficiency mode of the present invention;

FIG. 8 is a diagrammatic view of an L-C bandpass filter in accordance with this invention; and FIG. 9 is a diagrammatic view of an L-C bandpass filter and EMI suppression voltage divider in accordance with this invention.

DETAILED DESCRIPTION OF THE INVENTION

Figure 1:
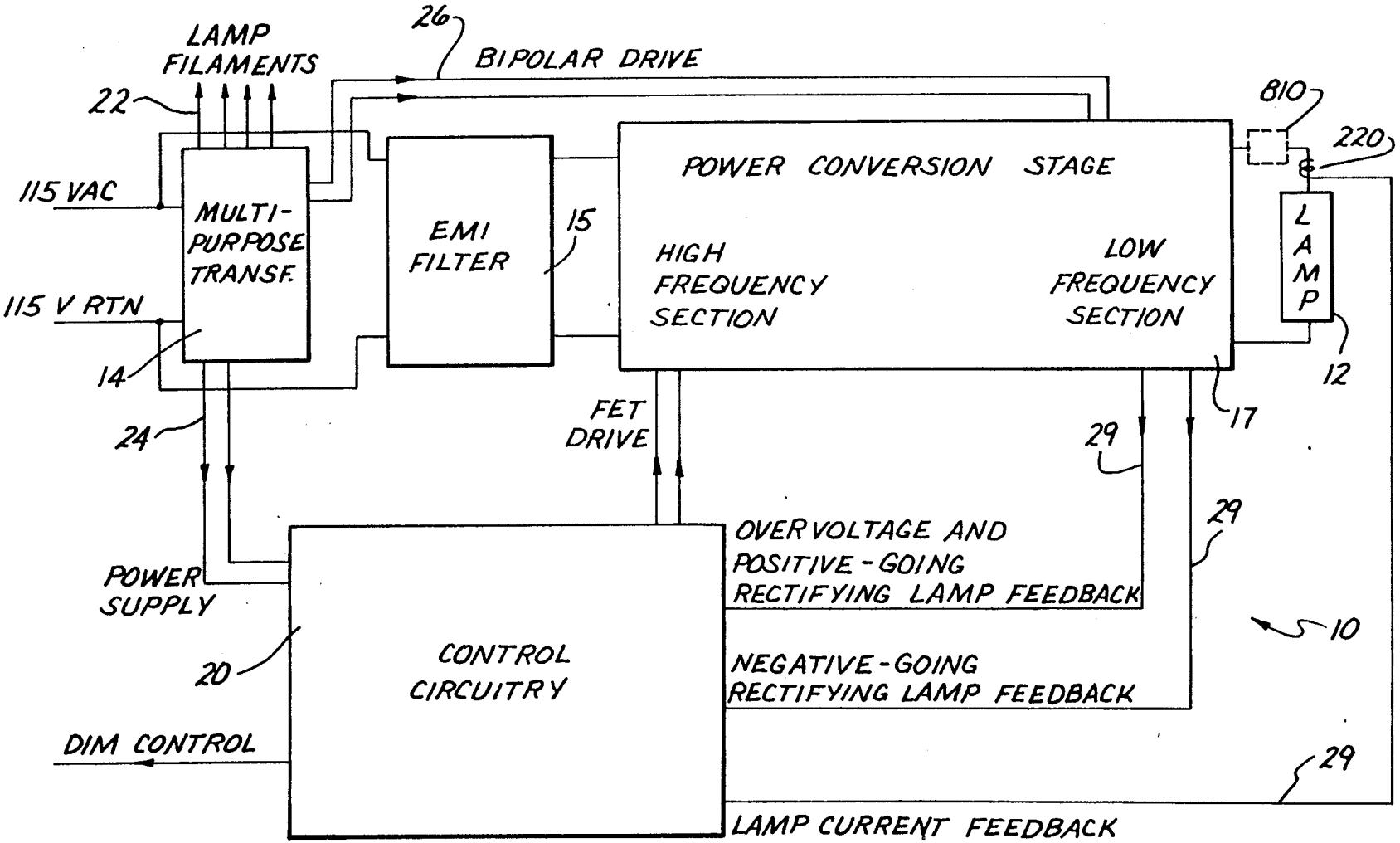
FIG. 1 is a block diagram of the ballast system of this invention.

Referring to the drawings which illustrate preferred forms of the present invention, FIG. 1 is a block diagram of the ballast system 10 in accordance with this invention and which provides power for a load in the form of one or more fluorescent lamps 12, although it s understood that the load may be other than fluorescent lamp(s), as will be described. The ballast system includes a multipurpose transformer 14 which receives an input in the form of a predetermined voltage and frequency, typically 115 V AC at 400 Hz, although the present invention is not limited to such an input. The 115 V return is also shown. The ballast system also includes an EMI filter 15, a power conversion stage 17 and a control circuitry 20, as indicated. The description initially will be with reference to a ballast system, although it is understood to apply to and AC power control system.

In general, the ballast system 10 operates to filter the input power for EMI purposes, then switched at a 50 KHz rate enabling the use of smaller power conversion components. The high frequency switched power is controlled by a pulse width modulator so as to maintain constant current in the lamp load, for example 265 mA. The high frequency power is then reconverted back to 400 Hz and filtered so as to provide a clean 400 Hz output which is 180 degrees out of phase with the input. This reduces EMI in the aircraft and extends lamp life. The system configuration is such that both the input and output currents are continuous thereby providing the advantage of a non-pulsating line current and thus reduced EMI and extended lamp life. A current feedback circuit which provides a value representative of only the lamp current without the filament current component is used to maintain lamp current constant in accordance with a preset and predetermined value over substantial line voltage and frequency variations. The current feedback circuit also maintains a reduced lamp current when in the dim mode. The same general feedback circuit also recognizes fault conditions in the lamp circuit such as short circuits, open circuits, shorted or open lamp filaments, and rectifying lamp loads. In the event of any of these conditions, the pulse width of the power conversion circuitry is automatically reduced sufficiently to maintain safe operation of the ballast.

The transformer 14 has several outputs, some of which are power for the lamp filaments, as indicated at 22, power voltages for the control circuitry 20, as indicated at 24, and switching voltages for the bipolar transistors in the output of the power conversion stage 17, as indicated at 26. Also, there is a feedback, as indicated at 29 to the control circuit 20 for the lamp current feedback loop, to be described.

The EMI filter generally includes a differential mode inductor, a common mode inductor and suitable capacitors cooperating to filter high frequency switching noise from the power conversion stage 17 to prevent the return of such noise to the 115 V AC input.

The structure and function of the power conversion stage 17 and the control circuitry are somewhat more complex and are best explained with reference to some further detailed schematics.

Figure 2:
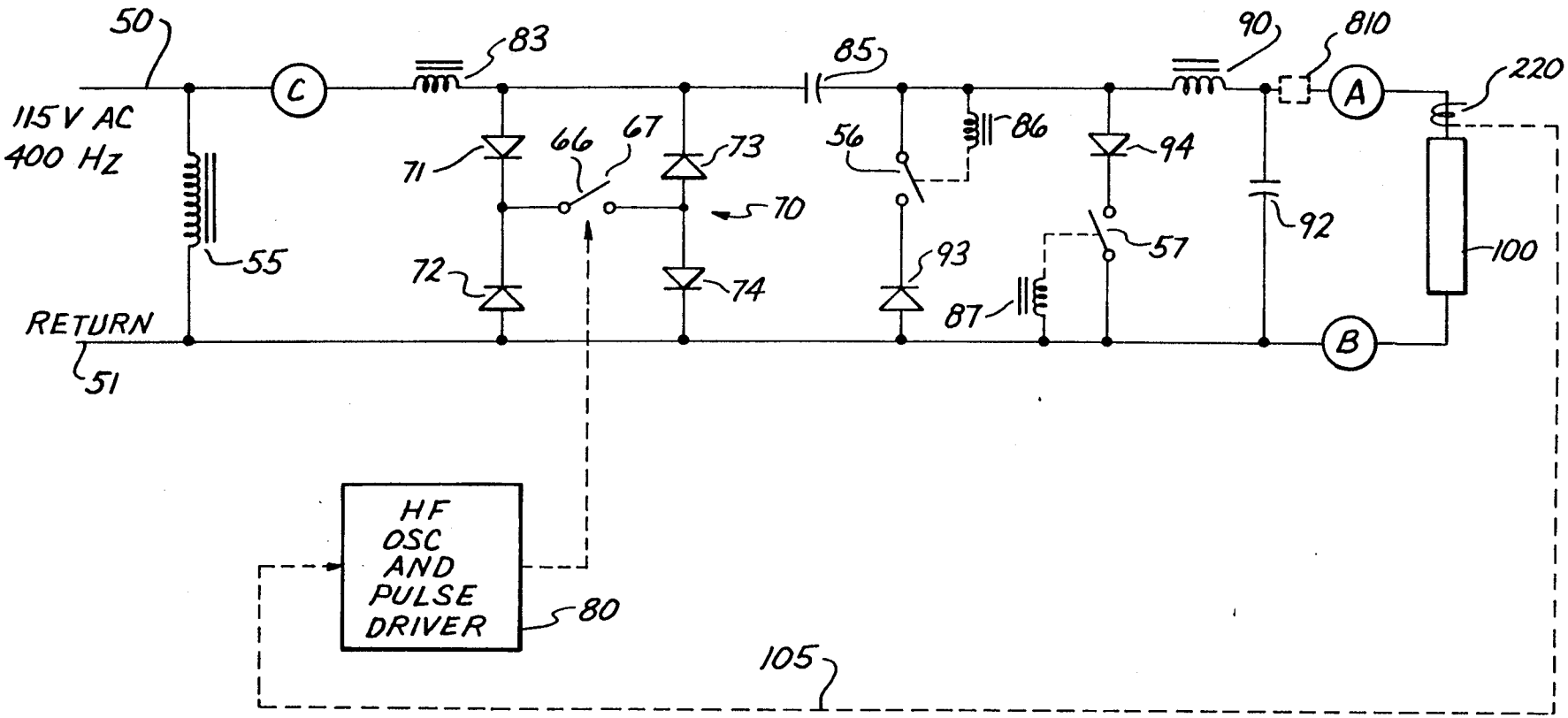
FIG. 2 is a simplified diagram of the power conversion stage for purposes of explanation of the present invention.

Referring to FIG. 2, the general structure and function of the power conversion stage 17 may be understood. The input power of 115 V AC at 400 Hz is shown at line 50 and the return or ground at 51, although, as noted other AC voltages and frequencies may be used. The incoming waveform is as illustrated in FIG. 2A, for example. Transformer 55 is a multi-purpose transformer used in switching transistor switches 56 and 57. Transistors 66 and 67 are symbolically represented as a single switch across a diode bridge 70 made up of diodes 71, 72, 73 and 74. The transistor switch 66–67 is actually one or more power transistors, preferably field effect transistors, and is switched by a high frequency oscillator and pulse driver 80, the latter part of the control circuitry 20. The oscillator may operate at 50 KHz although a wide range of other frequencies may be used.

The inductor 83 is an energy storage choke while capacitor 85 is an energy storage capacitor. The transistors 56–57, shown symbolically as switches, form a charging path for capacitor 85, as will be described, and are driven off the secondaries 86 and 87 of the transformer 55. A second inductor 90 and associated capacitor 92 form a low band pass filter intended to remove high frequency components from the output waveform appearing across A and B.

The basic operation is as follows. Assume that the incoming AC is at the positive peak of the waveform, see FIG. 2A, of about 163 V, transistor switch 66–67 being operated at a frequency of 50 KHz opens and closes at that frequency If switch 66–67 is closed, as illustrated in the drawing, the instantaneous line voltage is applied to inductor 83 and current now flows through inductor 83, diode 71, the transistor switch 66–67 and diode 74 to the return line 51. The result is that a flux field is built up in inductor 83 and the voltage drop across the inductor 83 is positive on the left side and negative on the right side, as seen in FIG. 2B. In the next 50 KHz half cycle, transistor switch 66–67 opens and the inductor 83 becomes a generator as its flux field collapses. The polarity of the generator is now positive on the right side and negative on the left side. The resulting current flow from the power line and inductor 83 is through capacitor 85 where the voltage drop again is positive on the left side and negative on the right side. Current flows through diode 94 to transistor switch 57 to the return line 51. Transistor switch 57 is closed during the entire positive-going 400 Hz half cycle by virtue of the 400 Hz drive applied by transformer secondary 87 to the transistor base, not shown for purposes of simplicity.

During the next 50 KHz half cycle, transistor switch 66–67 is again closed. It is important to note that two things happen whenever switch 66–67 is closed. First, the positive-going AC line charges inductor 83 and secondly, the positive side of capacitor 85 is grounded to the return line through diode 71, switch 66–67 which is closed and diode 74. As a result, the negative side (right hand side) of capacitor 85 suddenly becomes several hundred volts negative with respect to the return line or ground. The negative-going pulse, in fact a series of negative-going pulses during each positive-going 400 Hz half cycle, cannot flow through transistor switch 56 and associated diode 93 since the latter switch 56 is open during each positive-going 400 Hz half cycle by virtue of the polarity of its drive winding. The negative-going pulse(s) cannot flow through diode 94 since that diode is back biased. Therefore, the negative-going pulses are conveyed through inductor 90, filtered by the combination of the inductor 90 and the capacitor 92 and applied to the load 100. The succession of pulses having sinusoidal energy distribution, and at a voltage level greater than or lesser than the incoming voltage, applied to the load is illustrated in FIG. 2C and the filtered form as applied directly to the load is illustrated in FIG. 2D.

It is noteworthy that whereas the waveform of FIG. 2A, the incoming power, is essentially clean and sinusoidal, the waveform of FIG. 2B is not, the latter showing the higher voltage succession of positive-going pulses, as compared to the incoming power, coming from the inductor 83. The same is true of the waveform of FIG. 2C which illustrates the higher voltage negative-going pulses coming from the capacitor 85. Note, however, that the waveform of FIG. 2D illustrates the filtered output which is essentially sinusoidal and clean and 180 degrees out of phase with the input waveform and of a voltage appreciably greater than the incoming system voltage. The waveform of FIG. 2C is essentially 180 degrees out of phase with that of FIG. 2B on a 400 Hz basis. The energy distribution of the waveforms of FIGS. 2B and 2C is essentially sinusoidal. It is also significant that the voltage V1 at the input, FIG. 2A, assumed to be 115 V, whereas the voltage V2 of FIG. 2B may be anywhere up to 500 V or more because of the inductive properties of 83. The value of V2 is a direct result of the pulse width applied to the transistor switch 66–67 by the high frequency oscillator and pulse driver 80. Depending on the pulse width used, the voltage of V2 may range from a small residual voltage to 500 V or more, assuming a 115 V input as per FIG. 2A. The very high voltage output results from the inductive properties of inductor 83. The voltage V3 as shown in FIG. 2C is essentially the same as the average magnitude of V2 of FIG. 2B, but is 180 degrees out of phase. Voltage V4 of the waveform of FIG. 2D is of the same phase as the waveform of FIG. 2C except the high frequency component has been removed and the resulting waveform is approximately sinusoidal and has an absolute magnitude approximately equal to the average value of voltage V3 of FIG. 2C.

From the above, it is apparent that an incoming 115 V AC waveform is increased to a maximum of 500 or so V AC by the low level pulse-width modulated control of the high frequency oscillator and pulse driver. The energy distribution of the resulting waveform remains approximately sinusoidal. The circuit thus functions to apply the inductive kickback of inductor 83 to the capacitor 85, the latter storing the charge for a half cycle and then applies the charge in a negative-going direction to the load, switch 56–57 (on alternate 400 Hz half-cycles) serving as the load path for charging the capacitor 85. The energy in capacitor 85 is applied during alternate 50 KHz half-cycles to the load 100 through the filter 90 and capacitor 92. The function of the circuit is thus to accept an input power of a certain frequency and voltage, control it, increasing the voltage by a factor of 4 to 5 or decreasing it as required and then through switches 56–57 to apply the energy of the capacitor 85 to the load via the described filter such that the load receives a clean, sinusoidal AC of exactly the same frequency as the input, the output being used as the starting and running power for fluorescent lamps. It is understood that such lamps may require up to 500 volts for starting purposes and then diminish to a running voltage consistent with the current requirement for the particular lamps being operated. While the circuit description has used a positive-going AC input as an example, a negative-going input functions in the same way that one of the except that all polarities are reversed.

From the above, it now becomes apparent advantages of the ballast of this invention is that the discharge kick-back of inductor 83 is used to charge the capacitor 85, which as already noted charges through either 56 or 57, depending on the particular 400 Hz half-cycle. In effect the charging path for capacitor 85 is different from the discharge path of that capacitor. Since one of the two switches 56 or 57 is always closed whenever capacitor 85 is charging, the charging current is effectively isolated from the discharge path and never seen by the load 100, i.e.,the inductive kick of the choke 83 is never seen by the lamp load because of the phased relation between the input voltage, the polarity of current flow in inductor 83 and capacitor 83 on the one hand, and transistor switches 56–57 on the other hand.

The energy stored in the capacitor 85 is applied during alternate 50 KHz half-cycles to the load. The charging path for storage capacitor 85 includes the steering transistor switch 56–57 and the steering diodes 93 and 94. The charging current tends to be heavy and the resulting voltage quite high at the beginning of a particular 50 KHz half-cycle, and diminishes in a well known manner during the course of the half-cycle. The voltage waveform is therefore not particularly desirable to appear in the load. Due to the functioning of switches 66 and 67 and switches 56 or 57, only the discharge current from capacitor 85 (and the attendant voltage) is actually seen by the load 100. This effectively eliminates the appearance of inductive transients in the load.

Thus, the ballast of this invention replaces a conventional magnetic ballast but with a smaller size and lower weight unit which is of increased efficiency. The ballast circuit is thus able to provide the relatively high voltages needed to strike the lamp, provides automatic control of lamp current after ignition by a feedback path 105 as seen in FIG. 2, all without the need for the large magnetic components heretofore used. Main power control switching occurs at a high frequency and this allows the use of a very small inductor 83 and capacitor 85 as compared to what would be needed at the fundamental frequency of the incoming power. The inductive transients which create high voltages are isolated from the load by virtue of the function of capacitor 85 and switches 56 and 57. It is believed that the isolation of the inductor from the load, as described is unique.

Referring now to FIG. 3 wherein the same reference numerals have been applied to the same components, some added details are provided especially with respect to the EMI section 15 and the feedback loop 105. Incoming power already described is first cleaned by an EMI filter which includes inductor 200 and capacitor 202 and a common mode inductor 205 which function as the EMI filter, as already described. The transformer 55 and the inductor 83 and transistor switch 66 and 67 with the coactive diodes 71, 72, 73 and 74 are also shown. The high frequency oscillator and pulse driver 80 is shown with the pulse output being applied through transformer 210, the latter an isolation transformer with the pulse being applied to the gates of the transistors 66 and 67 as illustrated. While field effect transistors (FET) may be used due to the approximately 50 KHz operating frequency, it is also possible to use bipolar transistors at frequencies useful with that type of transistor. Capacitor 85 is also shown along with transistor switches 56 and 57 and cooperating steering diodes 93 and 94. In effect, the charging path and discharge path of the capacitor 85 is different so that the inductive kick of inductor 83 and the resulting current flow through the capacitor 85 are not seen by the load. The charging path for capacitor 85 includes the steering transistors 56-57 and the steering diodes 93 and 94. Protective diodes 211, 212, 213 and 214 are also shown and operate to prevent the switching transistors 56 and 57 from being improperly biased during their operating cycles. As already described, the transistor switches 56 and 57 are switched by the secondary windings 86 and 87 of the transformer 55.

Inductor 90 and cooperating capacitor 92 forming the output filter are as previously described. The load 100 in the form of fluorescent lamps is illustrated in greater detail, including the filaments 215 powered by the secondary windings 217 and 218 of transformer 55. Also illustrated is the novel feedback transformer 220 whose primaries 220A and 220B are connected in series with the filament voltage in order to buck out the filament current. This in turn causes the voltage appearing in the secondary 220C of transformer 220 to be an analog of the arc current of the fluorescent lamp, in contrast to the sum of the arc current and a component of the filament current. The feedback transformer forms part of the feedback loop 105.

The secondary 220C of the feedback transformer 220 is connected to a full wave rectifying bridge 225 composed of diodes 226, 227, 228 and 229. The output of the bridge 225 is an analog of the lamp current only and is stored in capacitor 230 in the interval between the half-cycles. The feedback voltage is applied through a scaling resistor 235 and a brightness adjustment potentiometer 238 to the inverting input of chip 240 which may be a 3525 chip having several functions. The brightness adjustment potentiometer 238, in contrast to the dimming adjuster switch 243, is factory set depending upon the current needed to operate the particular lamp. It is normally set to provide full brightness, e.g., 265 mA. The dimming adjuster 243 operates to set the operating dim conditions, e.g., 25% or 50% etc. of the maximum operating brightness. It is understood, however, that the illumination of the lamp may be infinitely adjustable, as will be described.

The chip 240 includes at least the functions of the frequency oscillator and pulse width driver, an operational amplifier (opamp) comparator, precision reference voltage and power supply functions for these various functions. The input power to 240 is 15 V DC, as indicated and the inverting input 242 is to the opamp comparator 250 section, the latter actually controlling the pulse width. The operation of the pamp comparator is essentially linear. The other input, a noninverting input, originates as a precision reference voltage within the chip 240 through scaling resistors in the form of a voltage divider 252 and is applied as the input 255. This scaled precision reference voltage is used as the fixed reference voltage against which the feedback voltage in loop 105 is compared for ultimate control of the pulse width and ultimately the current flow to the lamp(s). For example, the originated precision reference voltage may be 5 V DC and the output of the voltage divider may be, for example 1.0 V DC as the input 255. The pulse width is variable from a minimum to a maximum. This range may represent from 0.0 mA to 400 mA or more. However, the magnitude of the reference voltage applied to the noninverting input 255 represents that particular voltage which the feedback voltage of loop 105 provides when the lamp current is 265 mA for optimum lamp operation in the full bright mode.

In the absence of any voltage from the current feedback loop 105 appearing as an input at the inverting input 242 of chip 240, the value of the reference voltage applied to the noninverting input 255 causes full pulse width at the output 260, striking the lamp. As lamp current rapidly increases towards 265 mA, which represents the optimum current for the lamp, feedback 105 now increases concurrently with the lamp current until at 265 mA, the feedback voltage in loop 105 approximately equals the reference voltage applied to input 255 of chip 240, whereupon chip 240 reduces the pulse width, so as to maintain a lamp current of 265 mA. Significantly, the current flow resulting from the operation of the filament, by transformer 218, is subtracted out by the primaries 220A and 220B. The result is that the voltage which flows through the bridge rectifier 225 is an analog voltage actually corresponding to the actual lamp current.

The feedback voltage initially rises as a function of lamp current until the voltage at the inverting input 242 is almost equal to the voltage applied to the noninverting input 255, at which time the pulse width is that required and the lamp current remains steady and at the desired level. Due to the high gain of chip 240, only a small differential voltage is necessary at the input of the comparator 250 to control the width of the output pulse.

The circuit is capable of overdriving the lamps, for example, providing 400 mA where the optimum operation is at 265 mA. If overdriven, lamp life is reduced and so is the life of the ballast. Thus, for example, if the lamp current (less filament current) exceeds the predetermined set point for any reason, for example, 265 mA, the resulting increase in voltage to the inverting input 242 results in a narrowing of the output pulse width and accordingly a reduction in the current flowing to the load. If the lamp current (less filament current) is less than the set point, the resulting decrease in voltage at the inverting input causes an increase in the pulse width and accordingly an increase in the current flowing in the lamp. In normal operation, the pulse width is between the minimum and maximum width. Typically a feedback voltage of less than about 1 V DC at the inverting input 242 causes increase in pulse width while a voltage of more than 1 V DC operates to reduce the pulse width in essentially a linear fashion. This relatively narrow width of pulse width sensitivity operates effectively to control lamp current within close limits. Variations in sensed current in the feedback loop may be the result of faults such as short circuits, shorted or open filaments, or open circuits, for example. Depending on the nature of the fault, the effect is to protect the power conversion stage, on the one hand, and on the other hand tends to cause the lamps to be dimmer. Once observed by a crew member, the dim lamp may be replaced.

In the case of step dimming as controlled by the brightness control 243, the voltage at the noninverting input 255 is reduced by virtue of the current drain through resistor 265 when the switch is placed in the dim mode. Since the voltage at the noninverting input has been reduced, the closed loop feedback 105 will diminish the current applied to the lamp load until the feedback voltage is approximately equal to the reduced command voltage at the noninverting input. The lamp current is now steady at a reduced level, equivalent to the desired reduced illumination in the dim mode. It is apparent that the lamp loads may be lit either in the full illumination or in the dim mode and may be switched from one mode to the other during operation of the lamps. In lieu of step dimming, a potentiometer or rheostat may be used to control lamp brightness. Other methods of summing the lamp brightness command voltage with the feedback voltage are possible as is common in the art.

The feedback loop also provides for overvoltage feedback and sensing of positive going rectifying lamp conditions as well as negative going rectifying lamp conditions. Referring to FIGS. 4 and 4A, the chip 240, the internally generated 5 V DC reference voltage, the voltage divider 252 and the noninverting input 255 are shown diagrammatically. The inverting input 242, previously described, is also shown. The input 242 is preferably a summed input of the current feedback loop of the lamps 270, as described, as well as an overvoltage feedback and positive going rectifying lamp feedback 272 and a negative going rectifying lamp feedback 273. In normal operation, the positive and negative waveforms of voltage and current are essentially uniform in amplitude both in the positive and negative directions. There are conditions which may result either in a positive or negative rectifying lamp feedback, depending on which side of the lamp may be at fault. Regardless of which side is at fault, the condition results in a rectifying condition in the sense that the lamp acts as a rectifier, rectifying lamp conditions, so-called. A typical such condition is illustrated as waveform I in FIG. 4A. Another condition which may arise is that the negative going voltage may be a much larger pulse than the corresponding positive voltage pulse as indicated as V in FIG. 4A. Circuit 272 senses the positive going rectifying lamp feed back and overvoltage condition while 273 recognizes the negative going rectifying feedback. The voltages generated are then summed to that of the current feedback and forms the inverting feedback 242 to the opamp comparator for pulse width control, as already described.

Figure 5:
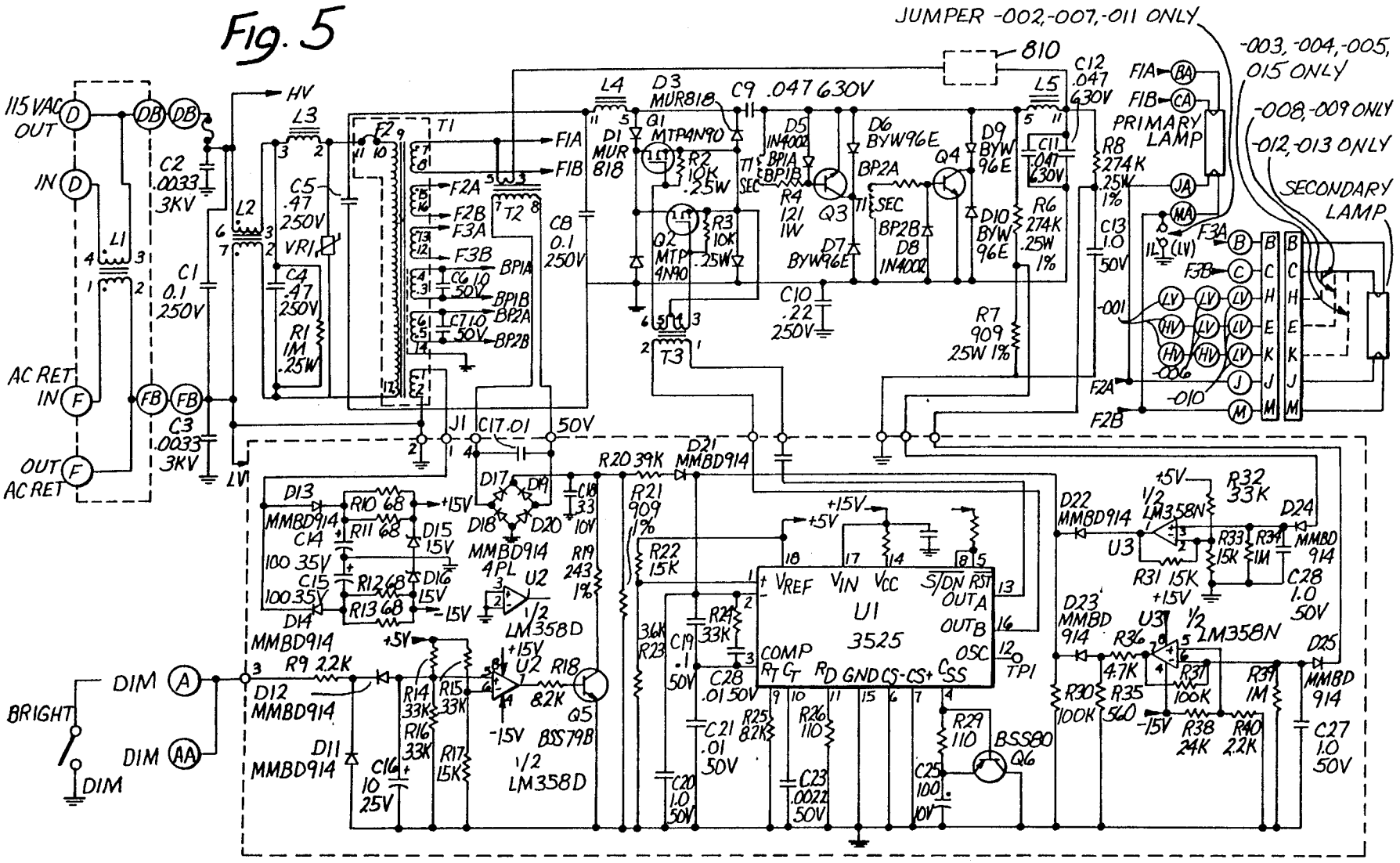
FIG. 5 is a detailed electrical diagram of one form of the ballast of the present invention as previously described in the prior figures for use on aircraft.

FIG. 5 is a detailed drawing of an actual detailed circuit which embodies the present invention. Unless otherwise noted in the drawing, all capacitor values are in miorofarads and all resistors are 0.125 W and all values are in ohms. The commercial designation of the various parts is also shown.

Since the structure and function of the circuit of FIG. 5 has already been described in connection with the prior drawings, the following will relate the components shown and to the structure and functions already described. T1 is the multi-purpose transformer with the secondaries indicated along with the phasing dots. All transformers are illustrated with the phasing dots for completeness. The BP set of outputs of T1 are used to control the switching transistors Q3 and Q4 (56–57), while the F set of outputs are filament voltages to the lamps. T2 is the feedback transformer (220) while L1 is the inductor, L2 the common mode inductor and C1 the capacitor, which along with capacitors C2, C3, C4 and C5 and inductor L3 form the EMI filter. VR1 is a Varistor used to prevent the passage of heavy voltage transients.

L4 is the inductor (83) which cooperates with the storage capacitor C9 (85), the latter charged by the kick back of inductor L4 as already described. Q1 and Q2 are the switching transistors switch (66–67) controlled by the high frequency oscillator and pulse driver (50 KHz) which is part of chip U1 (3525). T3 is the transformer which functions to connect the output of the high frequency oscillator and pulse driver from pins 13 and 16 of U1 to Q1 and Q2. L5 is the filter inductor which cooperates with the parallel capacitors C11 and C12 to remove the high frequency components from the output of storage capacitor C9. As shown, transformer T2 is the feedback transformer and forms part of a current feedback system, cooperating with diode bridge D17–D20.

Pin 1 of U1 is noninverting input from the voltage divider R22 and R23 and which provides the precision reference voltage. The inverting input is at pin 2 of U1, the input being the summed output of the voltage from the lamp current (less filament current) feedback loop and the other feedback loops. The positive going rectifying lamp and overvoltage feedback includes the upper half of U3 and positive going diode D24 and associated circuitry. The voltage divider R6 and R7, cooperating with the components mentioned senses the AC voltage if too large and the positive going rectifying lamp conditions. The negative going rectifying lamp feedback is the lower half of U3 and the negative going diode D 25 and associated circuitry. Capacitor C13 is rather large and connected to the output of the ballast and to ground through R8 and does not charge under normal conditions where there is no DC in the output of the ballast. The DC in the ballast output is caused by negative going rectifying lamp conditions. These outputs are summed and form the input to pin 2 of U1 for control of the pulse width, as described.

Chip U1 includes input pin Css which forms the "soft start" for the lamps. Effectively, this allows the pulse width to ramp up over a short period, about 2 seconds, at start up to allow the filaments to warm up before the operating current is applied. C25 is a timing capacitor cooperating with Q6 for the Css input.

The circuit associated with diodes D13 and D14 forms a + and −15 V DC power supply for the various circuit components which operate at those voltages, as indicated by the legends on the drawing. Q5 and associated high gain amplifier U2 form part of the step dimming circuit which also includes a noise suppression feature. In effect Q5 operates as a switch under the control of U2, the latter a high gain amplifier which is on or off, and with R9 operating as an impedance against D11 to prevent negative spikes from damaging the circuit. When in the normal (bright) mode, D12 does not conduct and thus U2 is on and Q5 is on with the result that the resistor R19, a burden resistor, loads the current feedback loop. In the dim mode, the load of resistor R19 is disconnected and operates to increase the gain of the current feedback loop reducing lamp current to the dim mode conditions. In effect, the feedback loop is rescaled to provide the dim mode.

R22 and R23 form a voltage divider which effectively sets the value of the reference voltage, with the values of one or the other or both being selected to provide the correct operating current for the lamp load. For full spectrum or infinite adjustment, these can be replaced by a potentiometer, or Q5 could be replaced by a rheostat. In either case, the effect is to vary the command voltage to the feedback loop for lamp intensity control.

The chip U1 also includes a COMP (compensating) terminal which provides a stabilizing feedback around a portion of the chip and back into pin 2 of U1. R24 is a feedback resistor for DC feedback, C19 is a capacitor for AC feedback, C21 is a wave shaping capacitor while C20 is a filter which limits the response of the feedback circuit. If not controlled, there is a possibility of lamp instability under certain conditions.

The ballast of FIG. 6, illustrated in two drawings, FIG. 6A and FIG. 6B, is essentially as already described with the exception that a single transistor switch Q1 is used rather than two as previously described. The values for the capacitors are in microfarads and resistors are 0.25 W and all values are in ohms. Transformer T3 of this figure is connected through diode D16 and burden resistor R10 to pin 3 of U1. If a threshold voltage is exceeded, due to some fault in the circuit, the system is shut down. Pin 1 is the inverting input and pin 8 is the noninverting input of U1, each of which has already been described. The remaining portions of this circuit are essentially as previously described, especially with respect to FIG. 5.

As noted, when the output of the ballast described is connected directly to a lamp load, the transistor switch must handle all of the power required by the lamp load. An alternate connection may be used in which the lamp load may be powered in part by the ballast and in part by the incoming AC power, with the result that efficiency is markedly increased as previously noted. One effect is to reduce the work load on the ballast. This arrangement is explained in FIG. 7 by a sequence of drawings showing step-by-step how the incoming power is used to power the ballast and to add to the output of the ballast.

Figure 7A:
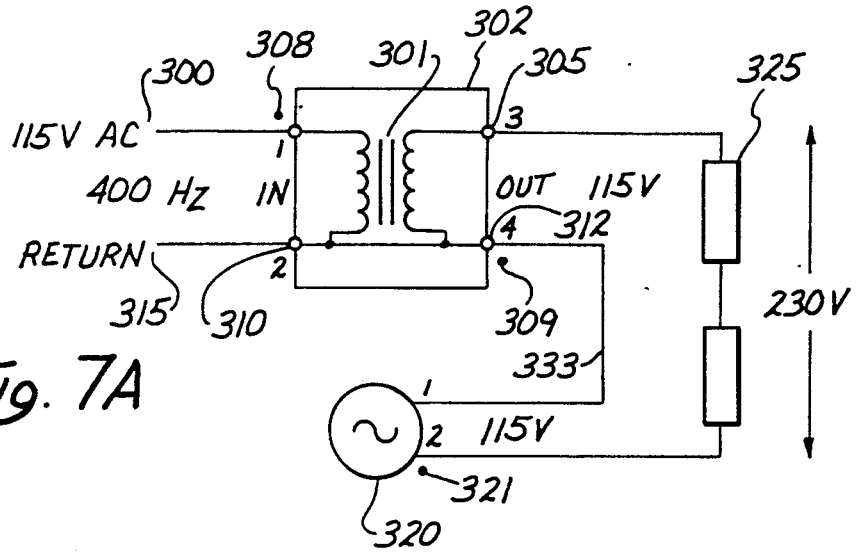

Referring to FIG. 7A, the incoming 115 V AC 400 Hz input 300 is connected to a transformer 301 contained in a housing 302. The output 305 of the transformer is out of phase with the input as indicated by the phasing dots 308 and 309. Terminals 310 and 312 are common, i.e., the return line 315 is common to the input and output of the transformer. Connected in series with the output of the transformer is an 115 V AC alternator 320, with the phasing dot 321 in the same relative position as phasing dot 309. In other words, the output of the transformer is in phase with the output of the alternator but out of phase with the input 300. The result is that the lamp load 325 sees 230 V (115 V from the transformer added to 115 V from the alternator). This is possible since both the output voltage of the transformer and that of the alternator are in phase with each other.

Figure 7B:
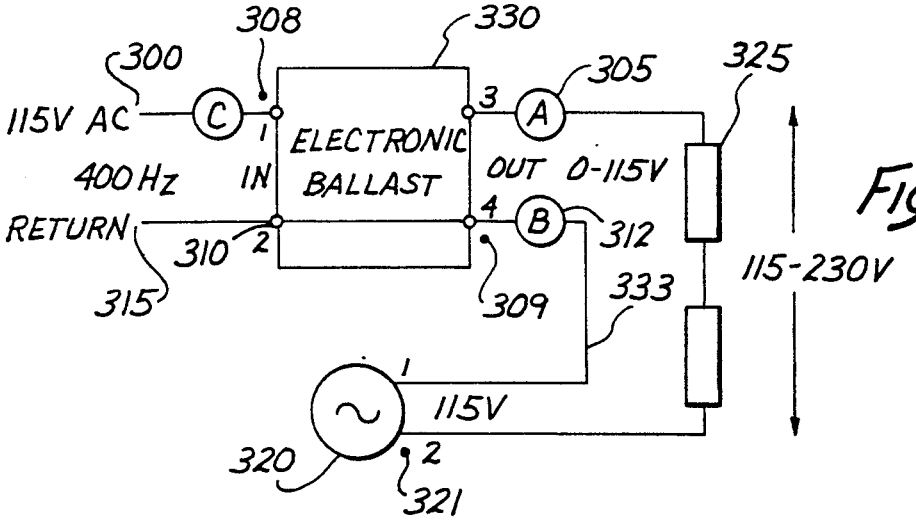

In the form of FIG. 7B, wherein the same reference numerals have been used for the same parts, the transformer has been replaced by a ballast 330, preferably as herein described. The phasing dots 308 and 309 are as illustrated, out of phase, and terminals 310 and 312 are again common but are the return line for the ballast. The alternator 320 is connected in series with the output of the ballast 330 and in phase with the ballast output as indicated by the phasing dots 309 and 321. The output of the ballast 330 is illustrated as 0 to 115 V due to the control action of the ballast. The load voltage is between 115 V and 230 V.

In the form of FIG. 7C, again using the same reference numerals for the same items, terminal 333 of the alternator has been connected to the return line of the ballast, i.e., the return line is common to the input and output of the ballast, the drawing again illustrating the relationship of the various phasing dots.

Figure 7C:
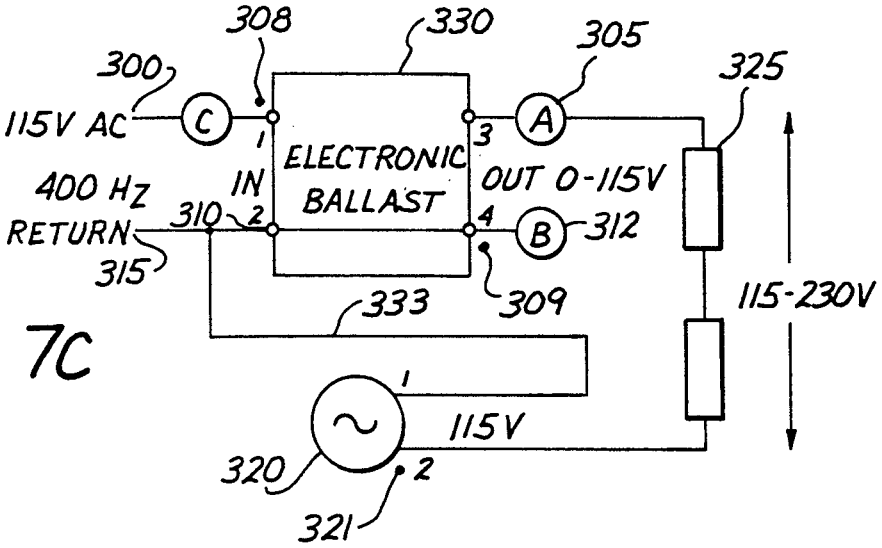
Figure 7D:
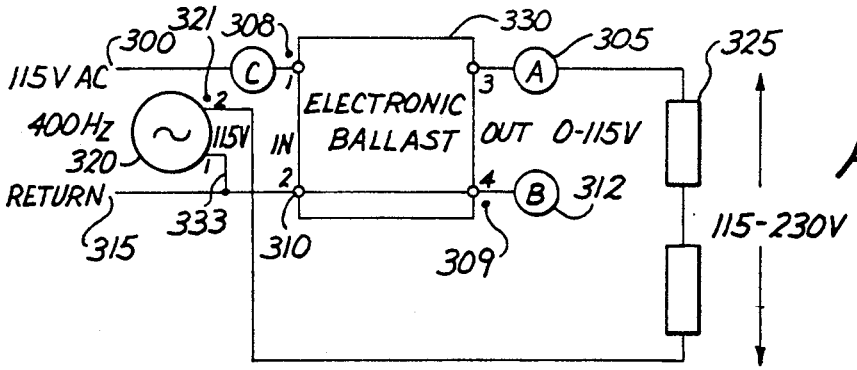

FIG. 7D is similar to FIG. 7C, however, the alternator has been redrawn. Note that the connections are the same as in FIG. 7C, as are the phase relationships.

Figure 7E:
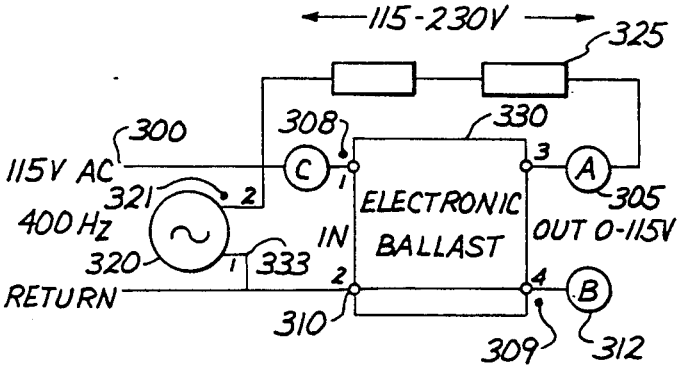

In the form of FIG. 7E, the fluorescent lamp load 325 has been redrawn, but the connections and phasing relationships are the same as in FIG. 7D.

Figure 7F:
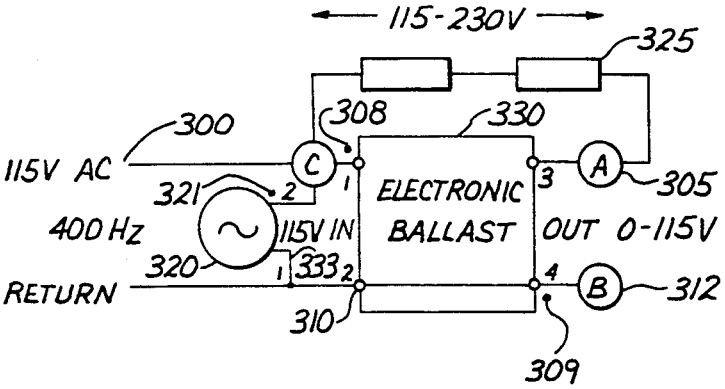

In FIG. 7F, the alternator remains in phase with the incoming power, and the magnitude of the two are the same. Here, however, the alternator has been connected in parallel across the incoming AC line. Such an arrangement is possible provided the incoming power and the output of the alternator are exactly in phase and of exactly the same voltage.

Figure 7G:
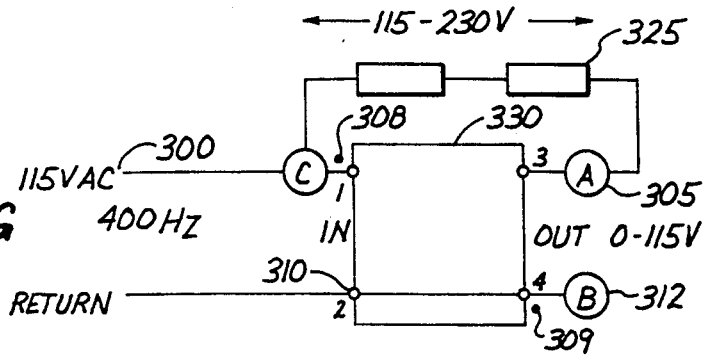

Since the output of the alternator is in phase with the incoming power and has the same voltage, it is possible to use the incoming power to supply the ballast 330 and also to supply the power supplied by the alternator. Such an arrangement is illustrated in FIG. 7G. The output of the ballast (0 to 115 V), depending on the current demand of the load)) is additive to the 115 V AC power from the powerline. This arrangement is possible due to the inherent 180 degree phase inversion of the ballast.

It is also important to note that depending on the lamp current required, the voltage to the load may be varied throughout the range of 115 V AC to 230 V AC to control the lamp current. It is thus necessary that the minimum operating voltage of the lamp be more than 115 V AC in order for the ballast to have control of the load.

The connections illustrated in FIGS. 7A to 7G are useful with large loads such as two 40 W fluorescent lamp loads. The current supplied by the ballast and that supplied by the alternator and the like are always the same since they are in series. However, the power supplied by the ballast is substantially less than would be the case if all of the power to the load were supplied directly by the ballast. In actual practice, with a pair of 40 W fluorescent lamps, the power line directly supplies more than half the power. The result is that the voltage in the ballast is much reduced over that otherwise necessary, resulting in greater ballast life, lower voltage ratings of the semiconductors and less heat is dissipated in all power path components of the ballast. The resulting improvement in reliability and reduction in cost and weight are considerable.

It is apparent that when the ballast of this invention is used as in FIG. 7 G, special advantages are achieved based on the advantages of the ballast of the present invention.

The systems previously described may be improved substantially through the use of a bandpass L-C filter in those cases where the input power to the system contains frequencies other than the fundamental input frequency, for example 400 Hz, as previously described. The bandpass filter is illustrated in FIG. 8 and includes an inductor 800 and a capacitor 805 in series therewith. The inductor may be in the form of a toroid winding on a silicon steel tape wound core with the capacitor being a metalized film capacitor. For example, the capacitor may be a 1.6 microfarad capacitor with the inductor being a 100 milliHenry inductor for the circuits described. The L-C filter is tuned to 400 Hz and thus passes that frequency and attenuates or substantially attenuates all other frequencies.

In a preferred mode, the L-C filter is placed in series with the load or lamps with the result that the filter is subjected only to the current to the lamp or load, which in one form of the invention is fixed by the feedback circuit to about 265 ma. If the filter is placed at the input side of the ballast or power controller, this subjects the filter to greater current flow. By connecting the filter as indicated, the filter is lighter in weight because it passes less current, and also tends to reduce EMI which is radiated from the load, especially fluorescent lamps because frequencies other than the fundamental frequency are attenuated. Another advantage is that the output voltage to the load, for example fluorescent lamp(s) is more sinusoidal than would be the case without the L-C filter.

For purposes of explanation the L-C filter 810 may be placed in series as indicated in dotted lines in FIGS. 1, 2, 3, 5 and 6A.

In those instances in which EMI is a consideration, the latter may be reduced further by the use of a shunt capacitor as seen in FIG. 9. There a capacitor 815, one side of which is grounded is connected to the output of the L-C filter. The capacitor may have a value of 0.015 microfarad and coacts with the L-C filter at 50 Kz for further EMI suppression. Where used, it may be connected as previously described.

While the preceding description was based principally on a ballast system, it will be apparent to those skilled in the art that the described system may also be used as an AC power controller where it is desired to control the the magnitude of AC power. In such as case, the L-C bandpass filter 810 may be used as well as the shunt capacitor 815, as circumstances warrant and positioned in the circuit as previously described. The AC power controller is a low source impedance unit because of the feedback circuit which offers flexibility as to whether voltage is fed back, or current is fed back, or a combination of the two. The effective feedback circuits also results in an AC power controller which is not damaged by short circuits.

It is contemplated that numerous changes, modifications and/or additions may be made by those skilled in the art to the specific embodiments of the present invention shown in the drawings and described above without departing from the spirit and scope of the present invention. Accordingly, it is intended that the scope of this invention be limited only by the scope of the appended claims.

What is claimed is:

1. A ballast system for use with a fluorescent lamp load for controlling the operation of the fluorescent lamp load from an incoming AC power source of a predetermined voltage and frequency and wherein the operation of the lamp load is controlled in accordance with the operating parameters of the lamp load comprising:

at least a power conversion stage including at least:

(1) inductor choke means and electronic switch means to change the voltage and the frequency of the incoming power from said incoming power source to a different voltage and higher frequency and of a generally sinusoidal energy distribution, (2) storage capacitor and electronic switching means operatively connected to said inductor means to provide an output voltage which is reconverted to the frequency of said incoming power source and 180 degrees out of phase with the output voltage of said inductor choke means, (3) filter means connected to receive the output of said storage capacitor means and connected to supply power to said lamp load, (4) means forming a charging path for said storage capacitor means, (5) means different from said charging path forming a discharge path into the load for said storage capacitor means whereby the charging current for said storage capacitor means is isolated from the lamp load during charging of said storage capacitor means, and the discharge of said storage capacitor means being operative to provide a series of discharge pulses having a sinusoidal energy distribution at a voltage level greater or less than that of the incoming voltage and of a value sufficient to operate said lamp load and being out of phase with the voltage of said incoming power source.

2. A ballast system as set forth in claim 1 wherein an L-C bandpass filter is connected in series between the output of said ballast system and said lamp load.

3. A ballast system as set forth in claim 2 wherein a shunt capacitor is connected between the output of the L-C bandpass filter and ground.

4. A ballast system as set forth in claim 1 wherein said inductor choke means includes switch means operated at a frequency greater than the frequency of the incoming power source, and said means forming the discharge path for said storage capacitor means including second switch means operated at a frequency different from said switch means.

5. A ballast system as set forth in claim 1 further including EMI filter means, and control circuit means for controlling the operation of said switch means.

6. A ballast system as set forth in claim 5 wherein said control circuit means includes an oscillator and pulse driver, the pulse driver having a variable pulse width output, said oscillator operating at a frequency higher than the frequency of the incoming power source, and feedback loop means sensing at least the current of the lamp load for generating a voltage for varying the width of the pulses from said pulse driver to provide a current output for operation of said lamp load which is sufficient to drive said lamp load but insufficient to overdrive said lamp load.

7. A ballast system as set forth in claim 1 wherein said power conversion stage further includes filter means connected to receive the output of said storage capacitor means, the output of said storage capacitor means being generally of sinusoidal energy distribution and of a voltage greater than the voltage from the incoming power source, and including a high frequency component, and said filter means operative to remove said high frequency component thereby providing a filtered sinusoidal output voltage which is out of phase with the incoming power source and of a voltage greater than the voltage of the incoming power source.

8. A ballast system as set forth in claim 1 further including dimmer means to control the illumination of the lamp load.

9. A relatively high efficiency, relatively light weight, relatively small electronic ballast for use in aircraft for controlling the operation of a fluorescent lamp load in the aircraft from an incoming AC power source of a given voltage and frequency, the latter having positive and negative going excursions, comprising;

means for switching the incoming power from said incoming AC power source during each positive and negative going excursion thereof at a frequency higher than the incoming frequency of the incoming power source, inductor means, storage capacitor means, said higher frequency voltage being operative to charge said inductor means repetitively during said positive and negative going excursions, said inductor means being operative to discharge into said storage capacitor means repetitively during each positive and negative excursion whereby the voltage stored by said storage capacitor is a multiple of the voltage of the incoming power source, and means to filter the output of said storage capacitor means whereby the voltage applied to the lamp load is out of phase with the voltage of the incoming power source and of a voltage which is a multiple or submultiple of the incoming voltage of the incoming power source.

10. A ballast system as set forth in claim 9 wherein an L-C bandpass filter is connected in series between the output of said ballast system and said lamp load.

11. A ballast system as set forth in claim 10 wherein a shunt capacitor is connected between the output of the L-C bandpass filter and ground.

12. A relatively high efficiency system for powering a fluorescent lamp load comprising:

a ballast as set forth in claim 9, means connecting an incoming power source in series with the output of said ballast and in phase with the output thereof whereby the output of said ballast is between 0 and 114 V AC and the load voltage is between 115 V and 23V AC.

13. A relatively high efficiency, relatively light weight, relatively small electronic ballast for use in aircraft for providing input power for controlling the operation of a fluorescent lamp load in the aircraft from an incoming power source of a given voltage and frequency comprising:

means forming an input for the incoming power and a return line therefor, a multi-purpose transformer connected to said means and providing suitable voltage and current levels for operation of filaments of the lamps and power voltages for a control circuit and switching voltages for switch means, an EMI filter including inductor means and capacitor means to filter out high frequency noise, power conversion stage means receiving the incoming power and including inductor storage choke means to change the voltage of said incoming power source, switch means cooperating with said inductor storage choke means to increase the frequency of the output thereof, energy storage capacitor means receiving the output of said inductor storage choke means and switching means to reconvert the frequency to essentially the original frequency but of a waveform which is approximately 180 degrees out of phase with the incoming power and of a voltage corresponding to the voltage of the output of said inductor storage choke means and connected to operate said lamp load, said EMI filter being connected between the incoming power source and the power conversion stage means, and control circuitry means cooperating with said switching means and including an oscillator and a pulse driver, the frequency of said oscillator being greater than the frequency of the input power whereby the output power for operation of said filament lamp load is changed in voltage and has a phase relation which is approximately 180 degrees out of phase with said incoming power from said power source.

14. A ballast system as set forth in claim 13 wherein an L-C bandpass filter is connected in series between the output of said ballast system and said lamp load.

15. A ballast system as set forth in claim 14 wherein a shunt capacitor is connected between the output of the L-C bandpass filter and ground.

16. A relatively high efficiency, relatively light weight, relatively small electronic ballast for use in aircraft for controlling the operation of a fluorescent lamp load in the aircraft from an incoming AC power source of a given voltage and frequency and of a generally sinusoidal waveform comprising:

means forming an input for the incoming power and a return line therefor, a multi-purpose transformer connected to said means and providing suitable voltage and current levels for operation of filaments of the lamps and power voltages for a control circuit and switching voltages for switch means, an EMI filter including inductor means and capacitor means to filter out high frequency noise, power conversion stage means receiving the incoming power and including inductor storage choke means to change the voltage of said incoming power source, switch means operative at a relatively high frequency greater than the frequency of the incoming power source and cooperating with said inductor storage choke means to increase the frequency and increase or decrease the voltage of the output of said inductive storage means, energy storage capacitor means receiving the output of said inductor storage choke means and second switch means to reconvert the frequency to essentially the original frequency but of a waveform which is approximately 180 degrees out of phase with the incoming power source and of a voltage corresponding to the voltage of the output of said inductor storage choke means and wherein the value of said voltage is greater or less than the voltage of the incoming power source, means connected to the output of said energy storage capacitor to remove any high frequency components therein and connected to operate said lamp load, said EMI filter being connected between the incoming power source and the power conversion stage means, control circuitry means cooperating with said switching means and including an oscillator and a pulse driver, the frequency of said oscillator being greater than the frequency of the input power, said pulse driver having a variable width output, means generating a reference signal for controlling the width of the output of said pulse driver, means forming a feedback loop for sensing voltage and current conditions in said lamp load for providing a sensed voltage, means comparing said sensed voltage and said reference voltage for adjusting the width of the output of said pulse driver and thus the current of said lamp load whereby the power of said lamp load is approximately 180 degrees out of phase with the incoming power and of a voltage several times greater or less than that of the incoming power, and dimmer means for controlling the illumination of said lamp load.

17. A ballast system as set forth in claim 16 wherein an L-C bandpass filter is connected in series between the output of said ballast system and said lamp load.

18. A ballast system as set forth in claim 17 wherein a shunt capacitor is connected between the output of the L-C bandpass filter and ground.

19. A relatively high efficiency, relatively light weight, relatively small electronic ballast as set forth in claim 16 wherein said incoming power is 115 V AC 400 Hz and said oscillator having a frequency of 1 KHz to 500 MHz.

20. An AC power controller for use with a load for controlling the operation of the load from an incoming AC power source of a predetermined voltage and frequency and wherein the operation of the load is controlled comprising:

at least a power conversion stage including at least:

(1) inductor choke and electronic switch means to change the voltage and the frequency of the incoming power from said incoming power source to a different voltage and a higher frequency and of a generally sinusoidal energy distribution, (2) storage capacitor and electronic switching means operatively connected to said inductor means to provide an voltage output which is reconverted to the frequency of said incoming power source and approximately 180 degrees out of phase with the output of said inductor choke means, (3) filter means connected to receive the output of said storage capacitor means and connected to supply power to said load, (4) means forming a charging path for said storage capacitor means, (5) means different from said charging path forming a discharge path into the load for said storage capacitor means whereby the charging current for said storage capacitor means is isolated from the load during charging of said storage capacitor means, and the discharge of said storage capacitor means being operative to provide a series of discharge pulses having a sinusoidal energy distribution at a voltage level greater or less than that of the incoming voltage and of a value sufficient to operate said load and being out of phase with said incoming power source.

21. An AC power controller as set forth in claim 20 wherein an L-C bandpass filter is connected in series between the output of said AC power controller and the load.

22. An AC power controller as set forth in claim 21 wherein a shunt capacitor is connected between the output of said L-C bandpass filter and ground.

23. An AC power controller as set forth in claim 20 wherein said inductor choke means includes switch means operated at a frequency greater than the frequency of the incoming power source, and said means forming the discharge path for said storage capacitor means including second switch means operated at a frequency different from said switch means.

24. An AC power controller as set forth in claim 20 further including EMI filter means, and control circuit means for controlling the operation of said switch means.

25. An AC power controller as set forth in claim 24 wherein said control circuit means includes an oscillator and pulse driver ,the pulse driver having a variable pulse width output, said oscillator operating at a frequency higher than the frequency of the incoming power source, and feedback loop means sensing at least the current of the load for generating a voltage for varying the width of the pulses from said pulse driver to provide a current output for operation of said load.

26. An AC power controller as set forth in claim 20 wherein said power conversion stage further includes filter means connected to receive the output of said storage capacitor means, the output of said storage capacitor means being generally of sinusoidal energy distribution and of a voltage greater than the voltage of the incoming power source, and including a high frequency component, and said filter means operative to remove said high frequency component thereby providing a filtered sinusoidal output voltage which is out of phase with the voltage of the incoming power source and of a voltage greater than the voltage of the incoming power source.

27. A relatively high efficiency, relatively light weight, relatively small electronic AC power controller for use in aircraft for controlling the operation of a load in the aircraft from an incoming AC power source of a given voltage and frequency, the latter having positive and negative going excursions, comprising:

means for switching the incoming power during each positive and negative going excursion thereof at a frequency higher than the incoming frequency of the incoming power source, inductor means, storage capacitor means, said higher frequency power being operative to charge said inductor means repetitively during said positive and negative going excursions, said inductor means being operative to discharge into said storage capacitor means repetitively during each positive and negative excursion whereby the voltage stored by said storage capacitor is a multiple or submultiple of the voltage of the incoming power source, and means to filter the output of said storage capacitor means whereby the power applied to the load is out of phase with the incoming power and of a voltage which is a multiple or submultiple of the incoming voltage of the incoming power.

28. An AC power controller as set forth in claim 27 wherein an L-C bandpass filter is connected in series between the output of said electronic power controller and the load.

29. An AC power controller as set forth in claim 28 wherein a shunt capacitor is connected between the output of the L-C bandpass filter and ground.

30. A relatively high efficiency system for controlling the power to a load comprising:

an AC power controller as set forth in claim 27, means connecting an incoming power source in series with the output of said AC power controller and in phase with the output thereof whereby the output of said AC power controller is between 0 and 115 V AC and the load voltage is between 115 V and 230 V AC.

31. A relatively high efficiency, relatively light weight, relatively small electronic AC power controller for controlling the operation of a load from an incoming AC power source of a given voltage and frequency comprising:

means forming an input for the incoming power and a return line therefor, a multi-purpose transformer connected to said means and providing suitable voltage and current levels for operation of the load and power voltages for a control circuit and switching voltages for switch means, an EMI filter connected to said multi-purpose transformer and including inductor means and capacitor means to filter out high frequency noise, power conversion stage means receiving the incoming power and including inductor storage choke means to change the voltage thereof, switch means cooperating with said inductor storage choke means to increase the frequency of the output thereof, energy storage capacitor means receiving the output of said inductor storage choke means and switching means to reconvert the frequency to essentially the original frequency but of a waveform which is approximately 180 degrees out of phase with the incoming power and of a voltage corresponding to the voltage of the output of said inductor storage choke means and connected to operate said load, and control circuitry means cooperating with said switching means and including an oscillator and a pulse driver, the frequency of said oscillator being greater than the frequency of the input power whereby the output power is changed in voltage and has a phase relation which is approximately 180 degrees out of phase with said incoming power source.

32. An AC power controller as set forth in claim 31 wherein an L-C bandpass filter is connected in series between the output of said AC power controller system and said load.

33. An AC power controller as set forth in claim 32 wherein a shunt capacitor is connected between the output of the L-C bandpass filter and ground.

34. A relatively high efficiency, relatively light weight, relatively small electronic AC power controller for controlling the operation of a load from an incoming AC power source of a given voltage and frequency and of a generally sinusoidal waveform comprising:

means forming an input for the incoming power and a return line therefor, a multi-purpose transformer connected to said means and providing suitable voltage and current levels for operation of the load and power voltages for a control circuit and switching voltages for switch means.

an EMI filter connected between the multipurpose transformer and the input power source and including inductor means and capacitor means to filter out high frequency noise, power conversion stage means receiving the incoming power and including inductor storage choke means to change the voltage thereof, switch means operative at a relatively high frequency greater than the frequency of the incoming power source and cooperating with said inductor storage choke means to increase the frequency and change the voltage of the output thereof, energy storage capacitor means receiving the output of said inductor storage choke means and second switch means to reconvert the frequency to essentially the original frequency but of a waveform which is approximately 180 degrees out of phase with the incoming power and of a voltage corresponding to the voltage of the output of said inductor storage choke means and wherein the value of said voltage is greater or less than the voltage of the incoming power source, means connected to the output of said energy storage capacitor to remove any high frequency components therein and connected to operate said load, control circuitry means cooperating with said switching means and including an oscillator and a pulse driver, the frequency of said oscillator being greater than the frequency of the input power, said pulse driver having a variable width output, means generating a reference signal for controlling the width of the output of said pulse driver, means forming a feedback loop for sensing voltage and current conditions in said load for providing a sensed voltage, means comparing said sensed voltage and said reference voltage for adjusting the width of the output of said pulse driver and thus the current to said load whereby the power to said load is approximately 180 degrees out of phase with the incoming power and of a voltage several times greater or less than that of the incoming power source.

35. An AC power controller as set forth in claim 34 wherein an L-C bandpass filter is connected in series between the output of said AC power controller and said load.

36. An AC power controller as set forth in claim 35 wherein a shunt capacitor is connected between the output of the L-C bandpass filter and ground.

37. A relatively high efficiency, relatively light weight, relatively small electronic AC power controller as set forth in claim 34 wherein said incoming power is 115 V AC 400 Hz and said oscillator having a frequency of 1 KHz to 500 MHz.

* * * * *